US011089919B2

(12) United States Patent
Yoshida

(10) Patent No.: US 11,089,919 B2
(45) Date of Patent: Aug. 17, 2021

(54) FILM-PACKAGED TISSUE

(71) Applicant: Daio Paper Corporation, Ehime (JP)

(72) Inventor: Shohei Yoshida, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 153 days.

(21) Appl. No.: 16/485,718

(22) PCT Filed: Mar. 16, 2018

(86) PCT No.: PCT/JP2018/010528
§ 371 (c)(1),
(2) Date: Aug. 13, 2019

(87) PCT Pub. No.: WO2018/180621
PCT Pub. Date: Oct. 4, 2018

(65) Prior Publication Data

US 2020/0069119 A1 Mar. 5, 2020

(30) Foreign Application Priority Data

Mar. 31, 2017 (JP) ..... JP2017-070191

(51) Int. Cl.
*A47K 10/20* (2006.01)
*B65D 85/07* (2017.01)
(Continued)

(52) U.S. Cl.
CPC ..... *A47K 10/20* (2013.01); *A47K 10/421* (2013.01); *B65D 75/12* (2013.01); *B65D 83/0805* (2013.01); *B65D 85/07* (2018.01)

(58) Field of Classification Search
CPC ..... A47K 10/20; A47K 10/24; A47K 10/32; A47K 2010/3266; A47K 10/421; B65D 85/07; B65D 75/12
(Continued)

(56) References Cited

U.S. PATENT DOCUMENTS 5,368,188 A * 11/1994 Twardowski ..... A47K 10/42 206/494
7,078,087 B2 * 7/2006 Romano, III ..... B65H 45/24 221/48
(Continued)

FOREIGN PATENT DOCUMENTS

JP 11506072 6/1999
JP 2004-209150 7/2004
(Continued)

OTHER PUBLICATIONS

International Search Report, PCT/JP2018/010528, dated May 29, 2018.

*Primary Examiner* — Rafael A Ortiz
(74) *Attorney, Agent, or Firm* — Andrus Intellectual Property Law, LLP

(57) ABSTRACT

A film-packaged tissue in which wrinkles or twisting is less likely to occur in tissue paper stored in the film package. A bundle of pop-up type tissue paper is film-packaged by a resin packaging film. The inner circumferential length of the packaging film in a short direction of the bundle is 91 to 97% of a theoretical outer circumferential length in the short direction of the bundle, and the compression characteristic (RC) of the film-packaged tissue by KES measurement at a longitudinal center of a bundle upper surface is 45 to 60%.

2 Claims, 4 Drawing Sheets

(51) Int. Cl.

| | |
|---|---|
| ***A47K 10/42*** | (2006.01) |
| ***B65D 75/12*** | (2006.01) |
| ***B65D 83/08*** | (2006.01) |

(58) Field of Classification Search
USPC ..... 206/494, 233, 412; 221/67
See application file for complete search history.

(56) References Cited

U.S. PATENT DOCUMENTS

| | | | | |
|---|---|---|---|---|
| 2002/0070141 | A1* | 6/2002 | Iida | B65D 83/0894 206/494 |
| 2004/0200751 | A1* | 10/2004 | Coonan | B65D 83/0805 206/494 |
| 2007/0095709 | A1* | 5/2007 | Saito | B65D 75/5838 206/494 |
| 2008/0044616 | A1* | 2/2008 | Hanao | A61F 13/15203 428/68 |
| 2010/0300915 | A1* | 12/2010 | Kakura | B65D 75/5838 206/494 |
| 2011/0240514 | A1* | 10/2011 | Bandoh | B65D 83/0805 206/555 |
| 2012/0175280 | A1* | 7/2012 | Bando | B65D 83/0805 206/494 |
| 2014/0190859 | A1* | 7/2014 | Yamada | B65D 75/5838 206/494 |
| 2014/0224698 | A1* | 8/2014 | Policicchio | B65D 83/0805 206/494 |
| 2016/0007812 | A1* | 1/2016 | Yamada | B65D 83/0894 206/494 |
| 2016/0022097 | A1* | 1/2016 | Bengtsson | B65D 75/5827 206/494 |

FOREIGN PATENT DOCUMENTS

| | | |
|---|---|---|
| JP | 2010-195443 | 9/2010 |
| JP | 2013-28401 | 2/2013 |
| JP | 2015-71427 | 4/2015 |

* cited by examiner

EXAMPLE 1

COMPARATIVE EXAMPLE 1

COMPARATIVE EXAMPLE 2

COMPARATIVE EXAMPLE 3

COMPARATIVE EXAMPLE 4

FILM-PACKAGED TISSUE

CROSS-REFERENCE TO RELATED APPLICATIONS

This application is the U.S. national stage application of International Application PCT/JP2018/010528, filed Mar. 16, 2018, which international application was published on Oct. 4, 2018, as International Publication WO 2018/180621 in the Japanese language. The International Application claims priority of Japanese Patent Application No. 2017-070191, filed Mar. 31, 2017. The international application and Japanese application are both incorporated herein by reference, in entirety.

TECHNICAL FIELD

The present invention relates to a film-packaged tissue in which a bundle of multiple pieces of tissue paper folded and stacked is packaged with a film.

BACKGROUND ART

Although the product form of tissue paper is mainly paper box packaging in which tissue paper is stored in a paper storage box called a carton, products in the form of film packaging in which tissue paper is packaged with a resin film are also widespread. The film-packaged product is also referred to as a "film-packaged tissue," and has an advantage of being easily made compact since a storage box is not required.

On the other hand, products related to tissue paper are sold side by side on display shelves at stores, but film packaging products are approximately the same size as compact products among paper box-packaging products in which approximately 150 sets of two-ply tissue paper are stored in a storage box with a height of about 45 mm, and it is easy to use display shelves for compact products.

However, the film-packaged product has less shape-retaining property than paper box-packaging products because a resin film to be an outer housing is a flexible material, and while being displayed on a shelf, stored tissue paper may have wrinkles and tear, etc. Consequently, the feeling of use and appearance at the time of taking out for use is deteriorated in some cases.

CITATION LIST

Patent Literature

Patent Literature 1: JP 2010-195443 A

SUMMARY OF INVENTION

Technical Problem

Therefore, the main object of the present invention is to provide a film-packaged tissue in which wrinkles or twists are less likely to occur to tissue paper in the film package.

Solution to Problem

Means for solving the above problems are as follows.

The first means is a film-packaged tissue in which a pop-up type bundle of tissue paper is film-packaged by a resin packaging film.

The inner circumferential length of the packaging film in the short direction of the bundle is 91 to 97% of a theoretical outer circumferential length in the short direction of the bundle, and the compression characteristics (RC) of the film-packaged tissue by KES measurement at the longitudinal center of a bundle upper surface is 45 to 60%.

The second means is the film-packaged tissue according to the first means, and the softness of the packaging film is equal to or less than 20 cN/100 mm.

Advantageous Effects of Invention

According to the present invention, provided is a film-packaged tissue in which wrinkles or twists is less likely to occur to tissue paper in the film package.

DESCRIPTION OF EMBODIMENTS

Figure 1:
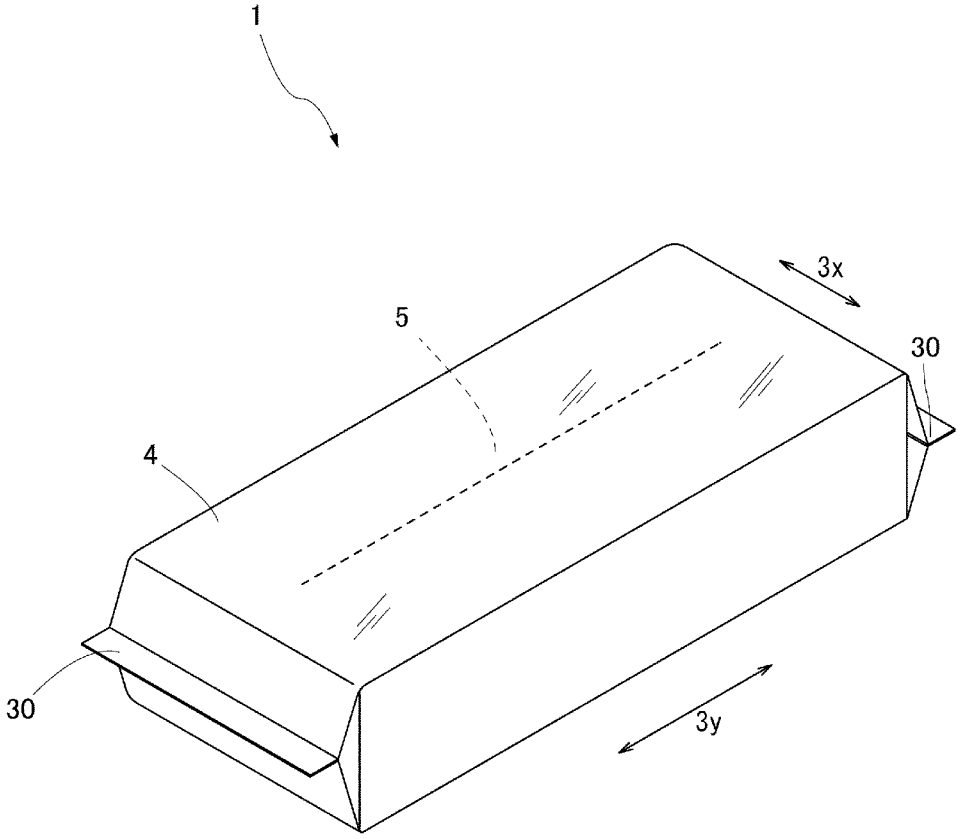
FIG. 1 is a perspective view of a film-packaged tissue of the present invention.
Figure 2:
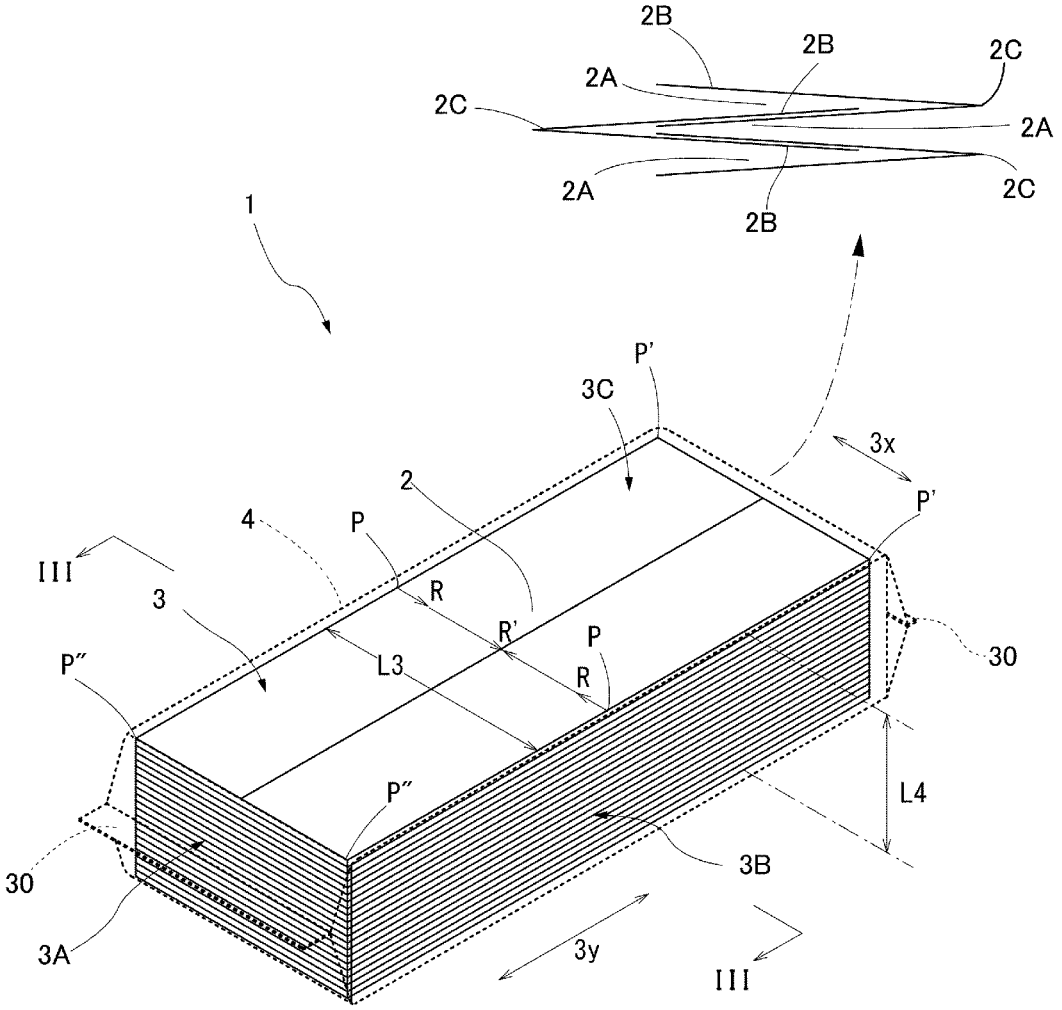
FIG. 2 is a perspective view for explaining a bundle of tissue paper according to the present invention.
Figure 3:
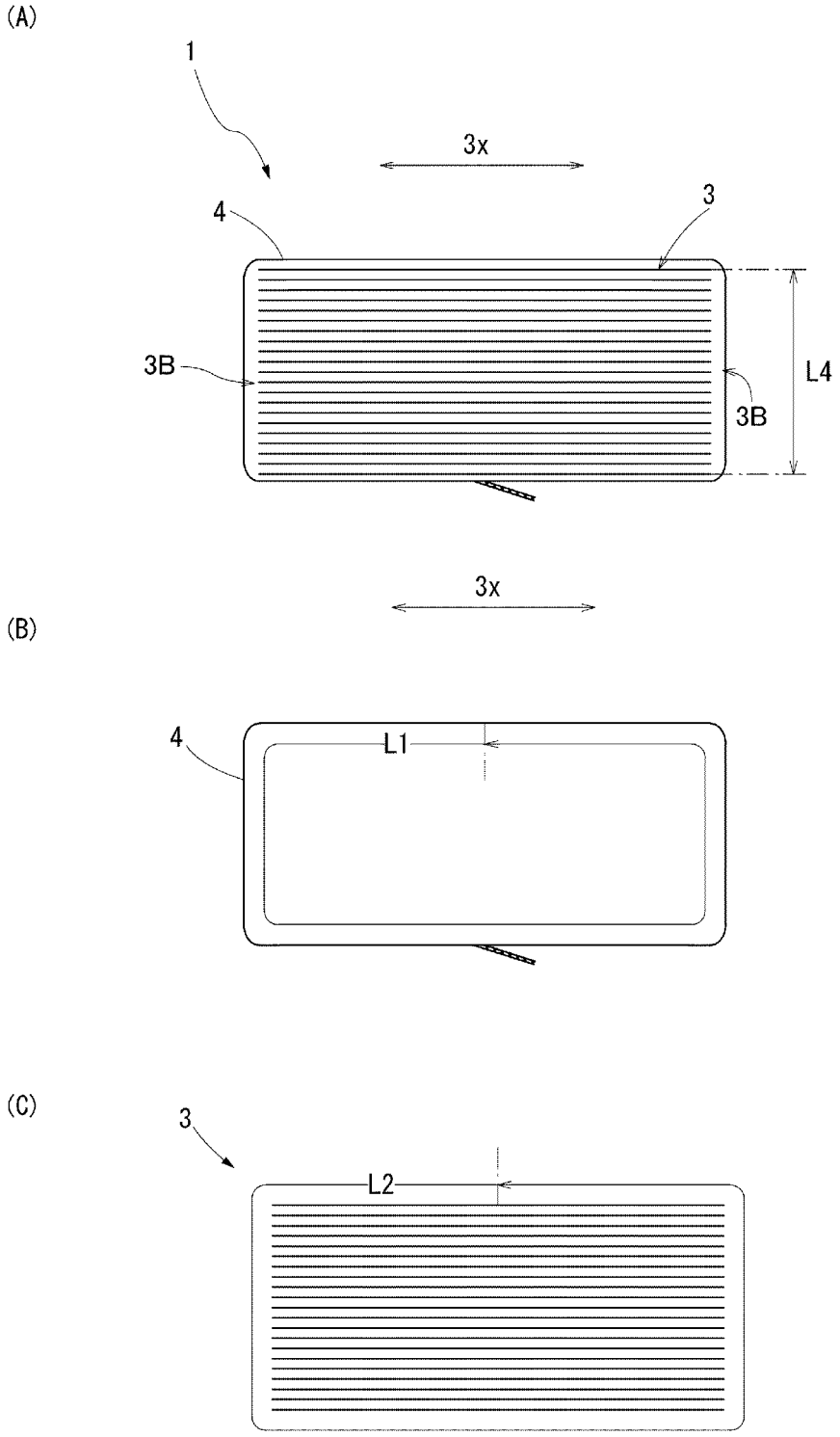
FIG. 3 is a cross-sectional view in the short direction of the film-packaged tissue of the present invention.

Hereinafter, an embodiment of the present invention will be described with reference to FIGS. 1 to 3. Now that, FIG. 1 is a perspective view of the film-packaged tissue of the present embodiment, FIG. 2 is a perspective view for explaining a bundle of tissue paper of the present embodiment, and FIG. 3 is a cross-sectional view taken along line III-III of FIG. 2 and is a cross-sectional view of the film-packaged tissue in the short direction. FIG. 3(*b*) is a view in which only a packaging film of FIG. 3(*a*) is extracted, and FIG. 3(*c*) is a view in which only a bundle of FIG. 3(*a*) is extracted.

In a film-packaged tissue 1 according to the present invention, a tissue paper bundle 3 formed by folding and stacking multiple sets of tissue paper 2 is packaged by a packaging film 4 made of flexible resin.

In the tissue paper bundle 3 contained in the film-packaged tissue 1 according to the present invention, multiple pieces of tissue paper 2 are folded and stacked such that the tissue paper 2 is folded in two and folded pieces 2B of other tissue paper 2 positioned above and below are positioned on the folded inner side 2A. The tissue paper bundle 3 is a pop-up type in which, when the uppermost folded piece is pulled upward, another adjacent folded piece immediately below is pulled up and lifted. This tissue paper bundle 3 can be manufactured by a multi-stand type or a rotary type known inter folder. Now that, the individual tissue paper 2 constituting the bundle 3 of the tissue paper 2 has a ply structure in which two to three thin paper sheets having a crepe are stacked to form a set. Furthermore, this tissue paper 2 is dried, namely, of a dry type, and not of a so-called wet type impregnated with a chemical solution. Thus, the above-described bundle 3 formed by the tissue paper 2 contains air.

On the other hand, the tissue paper bundle 3 according to the present invention has a pair of longitudinal side surfaces 3B in which folded edges 2C of each tissue paper 2 are aligned, a pair of short side surfaces 3A in which the folded edges 2C are not aligned, and a pair of flat surfaces (upper and lower surfaces) 3C connected to the short side surface 3A and the longitudinal side surface 3B. Thus, it has a substantially rectangular parallelepiped shape. This bundle is made of soft tissue paper 2 and is flexible and easily deformed.

Examples of the packaging form of the film-packaged tissue 1 according to the present invention include pillow packaging and caramel packaging, and pillow packaging is desirable. In particular, the pillow packaging is desirable in which a heat sealing portion 30 formed by heat sealing an overlapping portion of the packaging film is positioned at a position facing the short side surface 3A where the folded edges 2C of the tissue paper 2 in the tissue paper bundle 3 are not aligned. A gusset pillow package as in the illustrated example may be used.

In the film-packaged tissue 1 according to the present invention, it is desirable that an opening perforation 5 be formed at a position facing the uppermost tissue paper 2 of the bundle 3 of the packaging film 4. The opening perforation 5 may be straight, but may be formed annularly to form an elongated opening. Now that, the opening perforation 5 may be covered by a removable sealing material. In the present embodiment, since the tissue paper bundle 3 is a pop-up type, when an opening is formed and the uppermost tissue paper 2 of the bundle 3 is pulled out from the opening, a part of the next tissue paper positioned immediately below the tissue paper 2 is exposed from the opening.

Here, the film-packaged tissue 1 according to the present invention is characterized in that the inner circumferential length L1 of the packaging film 4 in the short direction 3*x* of the tissue paper bundle 3 is 91% or more and 97% or less of the theoretical outer circumferential length L2 in the short direction 3*x* of the tissue paper bundle 3. Here, in the present invention, in particular, it is important that the longitudinal side surface 3B formed by stacking the folded edge 2C of the tissue paper is included in the surface constituting the periphery of the tissue paper bundle 3 in the short direction 3*x*. Due to the structure of the pop-up type tissue paper bundle 3, the upper surface 3C and the bottom surface 3C are likely to be sheared in the short direction 3*x* than in the longitudinal direction 3*y*. Furthermore, in the state of the tissue paper bundle 3, the tissue paper 2 is likely to be deformed in the vicinity of the folded edge 2C. Therefore, if the inner circumferential length L1 of the packaging film 4 in the short direction 3*x* of the tissue paper bundle 3 and the theoretical outer circumferential length L2 of the short direction 3*x* of the tissue paper bundle 3 have the above relationship, the movement of the bundle 3 is appropriately restrained in the packaging film 4, and the occurrence of wrinkles or twists of the tissue paper 2 is significantly reduced.

Here, the inner circumferential length L1 of the packaging film 4 in the short direction 3*x* of the tissue paper bundle 3 is the circumferential length of the portion facing the short direction periphery of the tissue paper bundle 3 of the packaging film 4 and does not include a portion where the packaging films 4 are overlapped each other due to heat sealing.

Furthermore, the theoretical outer circumferential length L2 in the short direction 3*x* of the tissue paper bundle 3 according to the present invention is a value obtained by calculating from the short direction width L3 of the tissue paper bundle 3 and the height L4 of the tissue paper bundle 3. That is, (theoretical outer circumferential length L2 in short direction 3*x* of tissue paper bundle 3)=(short direction width L3 of tissue paper bundle 3)×2+(height L4 of tissue paper bundle 3)×2. The short direction width L3 of the tissue paper bundle 3 is an average value of the lengths of three points of the length in each short direction of both ends in the longitudinal direction and the length in the short direction of the center in the longitudinal direction of the tissue paper bundle 3 when the tissue paper bundle 3 is viewed from the top surface side. Furthermore, the height L4 of the tissue paper bundle 3 is calculated by the thickness of one set of tissue paper (one set of ply) constituting the bundle 3 and the number of tissue papers constituting the bundle 3. That is, (height L4 of tissue paper bundle 3)=(paper thickness of one set of tissue paper)×(number of sets×2). (number of sets×2) is set because a pop-up type tissue paper bundle is formed by folding a set of tissue paper in two and stacked. Furthermore, the paper thickness for calculating the theoretical outer circumferential length L2 may be measured before and after packaging of the packaging film. However, the thickness of the paper is measured after sufficiently conditioning the tissue paper under the conditions of JIS P 8111 (1998), and measured using a dial thickness gauge (thickness measuring instrument) "PEACOCK G type" (made by Ozaki MFG Co., Ltd.). In the specific measurement procedure, a plunger is placed on a measurement stand after confirming that there is no dust or dirt between the plunger and the measuring stand, a memory of the dial thickness gauge is moved to set a zero point, then the plunger is moved up to place a sample on a test stand, the plunger is moved down slowly, and a gauge is read at this time. At this time, the plunge is just placed. A terminal of the plunger is made of metal and has a circular plane which has a diameter of 10 mm and perpendicularly contacts a paper plane, and the load at the time of measuring the thickness is about 70 gf at 120 μm. Now that the thickness is an average value obtained by measuring ten times. Now that, from the viewpoint of the feeling of use as tissue paper, it is desirable that the specific paper thickness of a set of tissue paper be in the range of 80 to 200 μm.

On the other side, in the film-packaged tissue 1 according to the present invention, the inner circumferential length L1 of the packaging film 4 in the short direction 3*x* of the tissue paper bundle 3 and the theoretical outer circumferential length L2 in the short direction 3*x* of the tissue paper bundle 3 have the above relationship. Furthermore, the compression characteristics (RC) of the film-packaged tissue 1 according to the KES method at the center position in the longitudinal direction of the bundle upper surface is 45 to 60%. That is, the compression characteristics (RC) by the KES method of the film-packaged tissue 1 at the existence position of the bundle is 45 to 60%. The measurement at the central position in the longitudinal direction of an upper surface of the bundle is performed at three points including positions of 15 mm from each end in the short direction of the bundle at the longitudinal center of the upper surface of the bundle and the center position in the short direction of the upper surface of the bundle, and measurement values are averaged. In the range of less than 15 mm from each end of the bundle in the short direction, accurate compression characteristics (RC) may not be measured. Here, the compression characteristic (RC) according to the KES method means that as it approaches 100%, the restoration in the height direction is increased. In the film-packaged tissue 1 according to the present invention, when the compression characteristic (RC) by the KES method is 45 to 60%, the adhesion between the packaging film 4 and the tissue paper bundle 3 and the restraint of the bundle 3 by the packaging film 4, in particular, the restraint of the bundle 3 in the height direction (which is also the thickness direction or the stacking direction), become appropriate. Furthermore, the restorability of the bundle 3 becomes appropriate, and wrinkles and twists are significantly less likely to occur to the tissue paper 2. This means that if the compression property (RC) of the film-packaged tissue 1 is low, when the bundle is once compressed, the bundle is not restored. Thus, it is considered that when the compression characteristic (RC) is low, when the bundle is deformed by an external force, the deformed state is maintained, and wrinkles and twists are easily formed on the tissue paper. Furthermore, it is considered that if the compression characteristic (RC) is high, when the bundle is deformed by an external force, the bundle is likely to move in the thickness direction in the packaging film. Therefore, wrinkles occur in a restoration process, and while the state is maintained, wrinkles and twists are likely to be formed on the tissue paper. It is considered that wrinkles and twists occur on the tissue paper due to this mechanism. In particular, in the film-packaged tissue 1 of the present invention, the compression characteristics (RC) by the KES method at the position where the tissue paper bundle is present in the state of being packaged with the packaging film 4 is in the above range, in relation to the inner circumferential length L1 of the packaging film 4 in the short direction 3*x* of the tissue paper bundle 3 and the theoretical outer circumferential length L2 in the short direction 3*x* of the tissue paper bundle 3, wrinkles and twists are significantly less likely to occur on the tissue paper 2.

Here, the compression characteristics (RC) according to the KES method are values measured by a handy compression measurement program under the following measurement conditions using a compression tester KES-G5 manufactured by KATO TECH CO., LTD. or a corresponding machine.

(Measurement Condition)

Force gauge: 1 kg

Compression (pressure) area: 2 $cm^2$

Compression speed: 0.2 cm/sec

Maximum compression load (upper limit load): 50 $gf/cm^2$

Number of compression repeated times per point: once

STOROKE SET: 2

SENS: 5

Measurement environment: Standard temperature and humidity (23° C./50% RH)

On the other hand, the packaging film 4 according to the present invention is desirably a flexible packaging film having a softness of 20 cN/100 mm or less, and more preferably 10 cN/100 mm to 15 cN/100 mm. If the packaging film 4 has this degree of bending resistance, the shape maintenance property of the packaging film 4 is excellent, and wrinkles and twists of the tissue paper to be contained is less likely to occur. Furthermore, the compression characteristic (RC) described above can be easily obtained.

The softness of the packaging film according to the present invention is measured according to the handle-o-meter method conforming JIS L 1096 E method. However, a test piece is made into a size of 100 mm×100 mm, and a clearance is set to 5 mm. The measurement is carried out three times each in the longitudinal direction and the short direction of the packaging film, and the average value of each is further expressed by the geometric average in cN/100 mm.

A specific flexible resin film material constituting the packaging film 4 can be exemplified by a single layer film or stacked laminate film including polyethylene film, polypropylene film, polyester film, polyethylene terephthalate film, nylon film, vinylidene chloride film, ethylene vinyl alcohol copolymer, or gas barrier film formed by performing a surface treatment, such as aluminum deposition, to those films. From the viewpoint of cost, polypropylene film and polyethylene film are preferable. The thickness of the film material may be selected in consideration of compression characteristics (RC) and softness.

In the film-packaged tissue 1 according to the present invention, the above-described compression characteristics (RC) can be easily obtained, and wrinkles or twists of the tissue paper 2 and the tissue paper bundle 3 itself hardly occurs. As a result, the physical properties of the tissue paper bundle 3 and the tissue paper 2 are desirably as follows.

First, it is desirable that the number of plies and the number of sets of the tissue paper 2 constituting the tissue paper bundle 3 be 100 to 220 sets as one set of two plies (two sheets are stacked). With the number of plies and the number of sets, the compression characteristics (RC) can be easily obtained, and the occurrence of wrinkles and twists are not more likely to occur.

Further, as the shape of the tissue paper bundle 3, it is desirable that the height be 30 to 50 mm, and the length in the short direction be 100 to 130 mm. The bundle can be set to the number of sets sufficiently necessary as a tissue paper product, and the rigidity of the bundle as a whole is sufficient. As a result, in relation to the inner circumferential length L1 of the packaging film 4 in the short direction 3*x* of the tissue paper bundle 3 according to the present invention and the theoretical outer circumferential length L2 in the short direction 3*x* of the tissue paper bundle 3, the occurrence of wrinkles and twists of tissue paper can be more effectively reduced. Now that the longitudinal length is preferably 150 to 250 mm. It can be large enough to be used as the tissue paper 2.

Furthermore, the tissue paper 2 according to the present invention may be a chemical solution application type tissue paper to which a moisturizing agent or the like is applied, but in the present invention, it is particularly desirable that the tissue paper 2 be a non-moisturizing general-purpose type tissue paper to which no moisturizing agent is applied. This is because the compression characteristics (RC) can be easily obtained, and the tissue paper itself is not easily wrinkled or twisted. However, the tissue paper 2 is not limited to the general-purpose type tissue paper, and as long as it has the above-described compression characteristics (RC), it may be a chemical solution application type tissue paper to which a moisturizing agent or the like is applied.

The basis weight per one thin paper sheet constituting each ply of the tissue paper 2 is desirably 9.0 to 13.0 $g/m^2$. Within a range of this basic weight, the compression characteristics (RC) can be easily obtained, and the tissue paper itself is not also easily wrinkled or twisted. Now that the basis weight here is on the basis of the measuring method of JIS P 8124 (1998).

Now that, as a raw material pulp of the thin paper constituting the tissue paper 2, NBKP and LBKP are blended. Waste paper pulp may be blended, but in terms of texture and the like, the tissue paper 2 may be composed of only NBKP and LBKP. The blending ratio is preferably NBKP:LBKP=10:90 to 80:20, and particularly preferably NBKP:LBKP=20:80 to 60:40.

The paper strength of the tissue paper 2 is preferably 200 to 600 cN/25 mm in dry strength in the MD (Machine Direction) and 100 to 250 cN/25 mm in dry strength in the CD (Cross Direction). The compression characteristics (RC) according to the present invention can be easily obtained. Furthermore, the paper strength is sufficient for use as a tissue paper. Now that the paper strength can be achieved by adding a paper strength agent at the time of paper making and by adjusting the paper making material such as CSF.

Furthermore, in particular, when the tissue paper bundle 3 is manufactured by a rotary inter folder, it is desirable that the elongation in the MD (tensile breaking elongation) of the tissue paper be 5 to 15%. When a bundle is manufactured by a rotary interfolder, the MD of the tissue paper matches the short direction of the bundle. In the bundle concerned, in particular, when the elongation in the MD (tensile elongation at break) of the tissue paper is 5 to 15%, in relation to the circumference length of the packaging film in the short direction of the tissue paper bundle according to the present invention and the circumference length of the short direction of the tissue paper bundle, superior to bundle shape retention, the occurrence of wrinkles and twists of tissue paper can be more effectively reduced.

The tissue paper 2 according to the present invention desirably has the softness of 0.90 to 1.30 CN/100 mm. The softness is one of the indicators of the property of being soft. When the softness is in in the above range, the compression characteristics (RC) according to the present invention can be easily obtained, and the softness is sufficient for use as a tissue paper. The softness according to the present invention is measured according to the handle-o-meter method conforming JIS L 1096 E method. However, a test piece is made into a size of 100 mm×100 mm, and a clearance is set to 5 mm. The measurement is performed five times each in the longitudinal direction and the lateral direction in one ply, and the average value of all ten times is represented in cN/100 mm.

The tissue paper 2 according to the present invention preferably has an MMD of 7.5 to 9.0. MMD is an indicator of smoothness. When the MMD is in the above range, the slipperiness with the packaging film becomes appropriate. In relation to the circumferential length of the packaging film in the short direction of the tissue paper bundle according to the present invention and the circumferential length in the short direction of the tissue paper bundle, the restraint of the bundle by the packaging film becomes appropriate, and the occurrence of wrinkles and twists of tissue paper can be more effectively reduced. Note that MMD is a value obtained by measuring using a friction tester KES-SE, KES-SESRU manufactured by KATO TECH CO., LTD. or a corresponding machine. MMD is the degree of variation from MIU (mean friction coefficient), and the smaller the number, the smoother. The measurement conditions according to the present invention are while bringing the contact surface of the friction element into contact with the surface of the measurement sample to which a tension of 20 g/cm is applied in a predetermined direction at a contact pressure of 25 g, moving 2 cm at a speed of 0.1 cm/s in substantially the same direction as the direction in which the tension is applied. Measurement is performed ten times, and the average value is taken as MMD. Now that, for the friction element, the standard-supplied piano wire sensor is used. This piano wire sensor has twenty piano wires each having a diameter of 0.5 mm adjacent to one another, and has a contact surface formed to have a length and a width of 10 mm. The contact surface is formed with a unit bulging portion whose tip is formed of twenty piano wires (curvature radius: 0.25 mm).

Embodiment

Next, with respect to the film-packaged tissue according to the present invention and the film-packaged tissue to be a comparative example, after pulling out the included tissue paper, the degree of wrinkles and twists has been visually confirmed. In addition, the sensory quality (smoothness and softness) of the tissue paper has been also evaluated. Table 1 indicates the evaluation results. Comparative examples 1-4 are conventional commercial products, which are procured from the market. Furthermore, Examples are products in which film-packaged tissues collective packaged in 5P and packaged in cardboard are transported and loaded in the same way as general distribution channels, like commercial products.

The thickness of the film material can be measured in conformity to the above paper thickness measurement method using a dial thickness gauge (thickness measuring instrument) "PEACOCK G-1A type" (manufactured by OZAKI MFG CO., LTD.) in the standard state.

Now that, in Table 1, the wrinkles and twisting are evaluated in five grades, and the case with the least wrinkles and twists is evaluated as "5", and the case with the most wrinkles and twists is evaluated as "1".

Similarly, the sensory is evaluated in five grades, and the case with the best feeling in actual use is evaluated as "5", and the case with the worst feeling is evaluated as "1".

Figure 4:
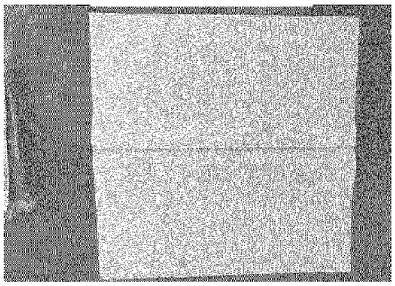
FIG. 4 is a view for comparing and explaining tissue paper according to Example of the present invention and tissue paper according to Comparative Examples.
Figure 4:
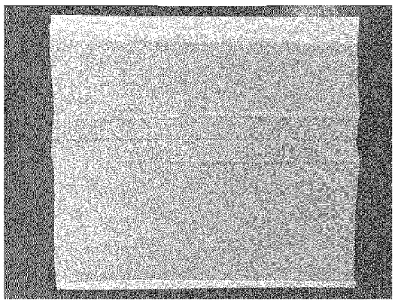
Figure 4:
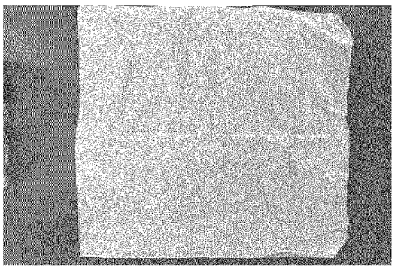
Figure 4:
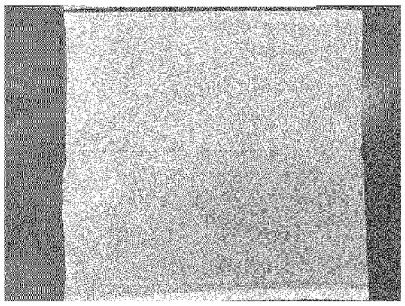
Figure 4:
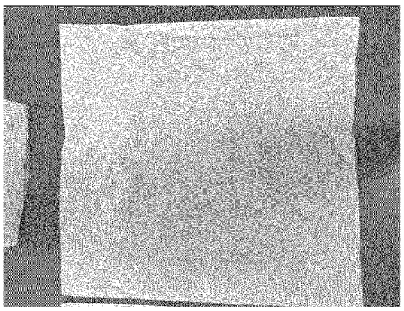

The form of the film-packaged tissue according to each example, the shape and physical properties of the tissue paper to be contained, the shape of the bundle, the inner circumferential length of the packaging film, and the like are indicated in Table 1 below. Furthermore, the degree of occurrence of wrinkles and twists and sensory evaluation are also indicated in Table 1. The tissue paper pulled out is illustrated in FIG. 4 in Example 1 and Comparative examples 1-4.

TABLE 1

| | | | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|---|---|
| PAPER QUALITY | SHEET SIZE (LONGITUDINAL) | mm | 201 | 200 | 201 | 195 | 200 | 206 | 194 |
| | SHEET SIZE (LATERAL) | mm | 185 | 185 | 185 | 205 | 185 | 195 | 206 |
| | NUMBER OF PLIES | PLY | 2 | 2 | 2 | 2 | 2 | 2 | 2 |
| | NUMBER OF SETS | SET | 150 | 150 | 150 | 150 | 150 | 150 | 150 |
| | BASIS WEIGHT | $g/m^2$ | 10.8 | 10.7 | 10.7 | 11.4 | 11.4 | 11.1 | 10.9 |
| | PAPER THICKNESS (TWO PLIES) | μm | 96 | 129 | 119 | 124 | 142 | 126 | 140 |
| | TENSILE STRENGTH (DRY), LONGITUDINAL | cN | 423 | 443 | 408 | 452 | 570 | 525 | 362 |

TABLE 1-continued

| | | | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|---|---|
| | TENSILE STRENGTH (DRY), LATERAL | cN | 161 | 172 | 137 | 210 | 167 | 227 | 165 |
| | TENSILE STRENGTH (WET), LATERAL | cN | 40 | 45 | 32 | 36 | 63 | 37 | 37 |
| | ELONGATION | % | 8.5 | 10.6 | 9.2 | 14.6 | 15.5 | 18.0 | 13.9 |
| | WEB VOLUME | mm | 34.8 | 44.7 | 41.5 | 44.0 | 47.0 | 46.0 | 47.4 |
| | SOFTNESS | cN/100 mm | 1.13 | 1.00 | 0.93 | 1.39 | 1.15 | 1.05 | 1.11 |
| | MMD | — | 8.5 | 9.0 | 8.4 | 9.6 | 8.1 | 7.0 | 8.3 |
| FILM PACKAGING TISSUE | BUNDLE, SHORT DIRECTION WIDTH | mm | 110 | 111 | 109 | 105 | 102 | 108 | 105 |
| | PACKAGING FILM, INNER CIRCUMFERENTIAL LENGTH (a) | mm | 268 | 274 | 271 | 280 | 275 | 280 | 278 |
| | BUNDLE, THEORETICAL OUTER CIRCUMFERENTIAL LENGTH (b) | mm | 277.6 | 299.4 | 289.4 | 284.4 | 289.2 | 291.6 | 294.0 |
| | a/b | % | 96.5 | 91.5 | 93.6 | 98.5 | 95.1 | 96.0 | 94.6 |
| | FILM RIGIDITY | cN/100 mm | 12.9 | 11.1 | 14.2 | 45.6 | 13.8 | 45.9 | 27.0 |
| | FILM MATERIAL | — | PP | PP | PP | PE | PP | PP | PP |
| | FILM THICKNESS | μm | 30 | 30 | 30 | 50 | 32 | 52 | 40 |
| | PACKAGING FORM | — | PILLOW | PILLOW | PILLOW | CARAMEL | PILLOW | CARAMEL | CARAMEL |
| KES METHOD MEASUREMENT VALUE | COMPRESSION CHARACTERISTICS (LC) *1 | (—) | 0.21 | 0.23 | 0.45 | 0.81 | 0.38 | 0.54 | 0.69 |
| | COMPRESSION CHARACTERISTICS (WC) *2 | (gf · cm/cm2) | 7.2 | 6.1 | 6.0 | 4.0 | 6.3 | 6.2 | 5.1 |
| | COMPRESSION CHARACTERISTICS (RC) *3 | (%) | 52.5 | 50.1 | 54.4 | 34.9 | 37.9 | 37.3 | 42.9 |
| SENSORY EVALUATION (FIVE STEPS) | PAPER SMOOTHNESS | | 5 | 5 | 5 | 2 | 3 | 4 | 3 |
| | PAPER SOFTNESS | | 3 | 3 | 3 | 2 | 3 | 3 | 3 |
| | PAPER WRINKLE (APPEARANCE) | | 5 | 5 | 5 | 1 | 2 | 2 | 3 |

*1 LINEARITY OF COMPRESSION CHARACTERISTICS (AS VALUE APPROACHES TO 1, COMPRESSION IS HARD)
*2 COMPRESSION POWER (AS VALUE INCREASES, EASILY COMPRESSED)
*3 RESTORABILITY BY COMPRESSION (AS VALUE APPROACHES TO 100, RESTORABILITY IMPROVES)

As indicated in Table 1, in Examples 1-3 of the present invention, the occurrence of paper wrinkles is significantly reduced as compared with Comparative examples 1-4. By comparing Example 1 of FIG. 4 with Comparative examples, it can be confirmed that the degree of occurrence of wrinkles is remarkably reduced in the Example 1. Thus, in the film-packaged tissue of the present invention, it can be confirmed that, in a film-packaged tissue, wrinkles or twists are less likely to occur to tissue paper in the film package.

REFERENCE SIGNS LIST

1 Film-packaged tissue
2 Tissue paper
3 Tissue paper bundle
2A Folded inner side
2B Folded pieces
4 Packaging film
2C Folded edge
3A Short side surface
3B Longitudinal side surface
3C Plane (upper and lower surface)
30 Heat sealing portion
5 Opening perforation
3*x* Short direction of bundle
3*y* Longitudinal direction of bundle
L1 Inner circumferential length of packaging film 4 in short direction
L2 Theoretical outer circumferential length in short direction of bundle
L3 Width in short direction of bundle
L4 Height of bundle

The invention claimed is:

1. A film-packaged tissue in which a pop-up type bundle of tissue paper is film-packaged by a resin packaging film, wherein an inner circumferential length of the packaging film in a short direction of the bundle is 91 to 97% of a theoretical outer circumferential length in the short direction of the bundle, and compression characteristics (RC) of the film-packaged tissue by KES measurement at a longitudinal center position of a bundle upper surface is 45 to 60%.

2. The film-packaged tissue according to claim 1, wherein the softness of the packaging film is equal to or less than 20 cN/100 mm.

* * * * *